US006361131B1

(12) United States Patent
Powell, Jr.

(10) Patent No.: US 6,361,131 B1
(45) Date of Patent: Mar. 26, 2002

(54) LINEAR ACTUATOR FOR RETRACTABLE PLATFORM

(76) Inventor: Edward S. Powell, Jr., P.O. Box 790, Jefferson, OR (US) 97351

( * ) Notice: Subject to any disclaimer, the term of this patent is extended or adjusted under 35 U.S.C. 154(b) by 0 days.

(21) Appl. No.: 09/664,903

(22) Filed: Sep. 18, 2000

(51) Int. Cl.[7] ..... A47B 51/00
(52) U.S. Cl. ..... 312/312; 187/254
(58) Field of Search ..... 108/20, 144.11, 108/147; 312/312, 319.7, 315.5; 187/251, 255, 254, 266

(56) References Cited

U.S. PATENT DOCUMENTS

| | | | | |
|---|---|---|---|---|
| 1,392,078 A | | 9/1921 | Quillett | |
| 1,634,854 A | | 7/1927 | Scollard | |
| 2,285,251 A | | 6/1942 | Cochran | |
| 2,565,304 A | | 8/1951 | Garstang et al. | |
| 3,025,651 A | | 3/1962 | Stanley | |
| 3,313,376 A | | 4/1967 | Holland | |
| 3,593,823 A | * | 7/1971 | Thompson | 187/255 |
| 3,719,295 A | | 3/1973 | Grace | |
| 3,724,688 A | * | 4/1973 | Atwater | 187/255 |
| 4,735,173 A | | 4/1988 | Dubreuil | |
| 5,271,483 A | | 12/1993 | Hong | |
| 5,469,936 A | | 11/1995 | Lauga et al. | |
| 5,657,851 A | | 8/1997 | Speckhart et al. | |
| 6,000,770 A | * | 12/1999 | Frich | 312/319.7 |

* cited by examiner

*Primary Examiner*—Peter M. Cuomo
*Assistant Examiner*—Jerry A. Anderson
(74) *Attorney, Agent, or Firm*—Karen S. Hock

(57) ABSTRACT

A linear actuator for a platform having a frame with an open end and a platform moveable within the frame, said platform driven by a motor powered axle mounted traversely to the platform. The platform is driven by a drive system powered by the motor driven axle and generally having a pair of fixed pitch independent devices, such as chains, each chain mounted at each of its ends to the frame and aligned with the platform's axis of travel, a double drive sprocket adjacent an end of the axle, a pair of double idler pulleys aligned substantially with a chain, a pair of single idler pulleys aligned substantially with the other chain. Each chain is routed through the double drive sprocket and one chain routes through the double idler pulley, while the other chain routes trough the both the double idler pulleys and the pair of single idler pulleys.

6 Claims, 3 Drawing Sheets

LINEAR ACTUATOR FOR RETRACTABLE PLATFORM

BACKGROUND OF THE INVENTION

1. Field of Invention

This invention relates generally to the field of retractable platforms, and more particularly to a chain or flexible member driven linear actuator for a retractable platform for a wide variety of components and uses for vertical as well as horizontal movement, depending on the application. Applications include utilization as a vertical retractable platform lift for components including computer monitors, T.V's, kitchen appliances, guns, book shelves and pictures from within a cabinet or from under a floor or down from a ceiling, and utilization as a horizontal retractable platform device for similar components from within a wall.

2. Description of Prior Art Components such as T.V.'s and computers and their monitors etc. are seen as unsightly by many and take up valuable working space such as desk tops and tables when not in use. Other components such as guns are dangerous, and some components are valuable and would benefit from hidden storage. In addition, there are many spaces such as mobile homes and other small living spaces where it is desirable to maximize space. Hence, it is desirable to provide a means of storing components compactly out of sight within furniture, walls, ceilings and floors when not in use and when it is desired to use them, to provide a simple and efficient means of gaining access to them, with a cost effective product. Therefore, compactness, ease of use, economical manufacture, and performance, particularly the ability of the platform to remain parallel during operation and over time, dictated the design of the linear actuator platform.

In platform lifts suspended by multiple chains or other flexible members, hereafter referred to simply as chains generally, unequal distribution of load on the platform results in differential chain stretch over time, adversely affecting the ability of a platform to remain parallel. Therefore, it is an objective of the invention to accommodate chain stretch, and more importantly differential chain stretch in the design.

The above stated objectives are achieved with the present invention through a unique routing of chains through idler pulleys uniquely positioned and driven and the compactness of the design. For instance, both the routing / placement and the compactness result in a shorter length of chain thereby reducing the effects of stretch.

The prior art shows various ways of raising and lowering retractable platforms, yet not one is able to meet all the objectives of the present invention.

For example, U.S. Pat. No. 2,285,251 to Cochran for an Industrial Truck requires pulleys operating at different speeds.

U.S. Pat. No. 2,565,304 to Garstang et al for a Radio-Phonograph Cabinet does not provide for a compact design of the box, has additional horizontal forces combined with its vertical lifting forces, and is prone to failure due to its simple chain drive and reliance on a single pin stopping the chain.

U.S. Pat. No. 3,719,295 to Grace for a Controlled Mechanical Storage Device includes what is termed "paralellogrammimg means" for horizontal movement of the carriage via driven flexible members, preferably chains, that are uniquely routed. This routing of the flexible members does not allow for the compactness of design, thereby necessitating a greater length of flexible member or chain, which creates issues of stretch resulting in lower performance and the need for adjustment.

U.S. Pat. No. 4,735,173 to Dubreuil for an Animal Transport Unit includes a moveable floor within a box from a lower to an upper position for ease in handling animals. This movement is accomplished with the utilization of rack and pinion means. U.S. Pat. No. 3,313,376 to Holland for a Lightweight Elevator similarly utilizes rack and pinion means. Rack and pinion means requires a significant manufacturing cost due to the need for precision components due to precision alignment constraints.

U.S. Pat. No. 5,469,936 to Lauga et al for a Support Device for an Item of Retractable Street Furniture is of a winch design and requires a continual feed of power to maintain the platform in the "up" position.

OBJECTS AND ADVANTAGES

Accordingly, several objects of the present invention are to provide a linear actuator for a platform that:

a. Provides a lifting and retraction or pushing and retracting platform and mechanism for objects while utilizing a minimum number of parts;

b. Allows for a compact profile if necessary for space considerations;

c. Maintains the platform in a parallel plane;

d. Is simple and economical to manufacture and easy to maintain.

These and further objects will be apparent from the following description and drawings of the preferred embodiments thereof.

BRIEF DESCRIPTION OF THE SEVERAL VIEWS OF THE DRAWINGS

FIG. 1 is perspective view showing partial cutaway views of the frame and platform.

FIG. 2 is a front view with the frame removed from the front showing the platform in a raised position.

FIG. 3 is the same view as FIG. 2 showing the platform in the lowered position.

FIG. 4 is cutaway view along lines 4—4 of FIG. 3 showing the routing of one chain and its respective idlers.

FIG. 5 is a cutaway view along lines 5—5 of FIG. 3 showing the routing of the other chain and its respective idlers.

DETAILED DESCRIPTION OF THE INVENTION

FIGS. 1–5 show a preferred embodiment of the linear actuator. In this embodiment, the linear actuator functions as a vertical retractable lift for components such as TV's, computer and their monitors and the like.

Figure 1:
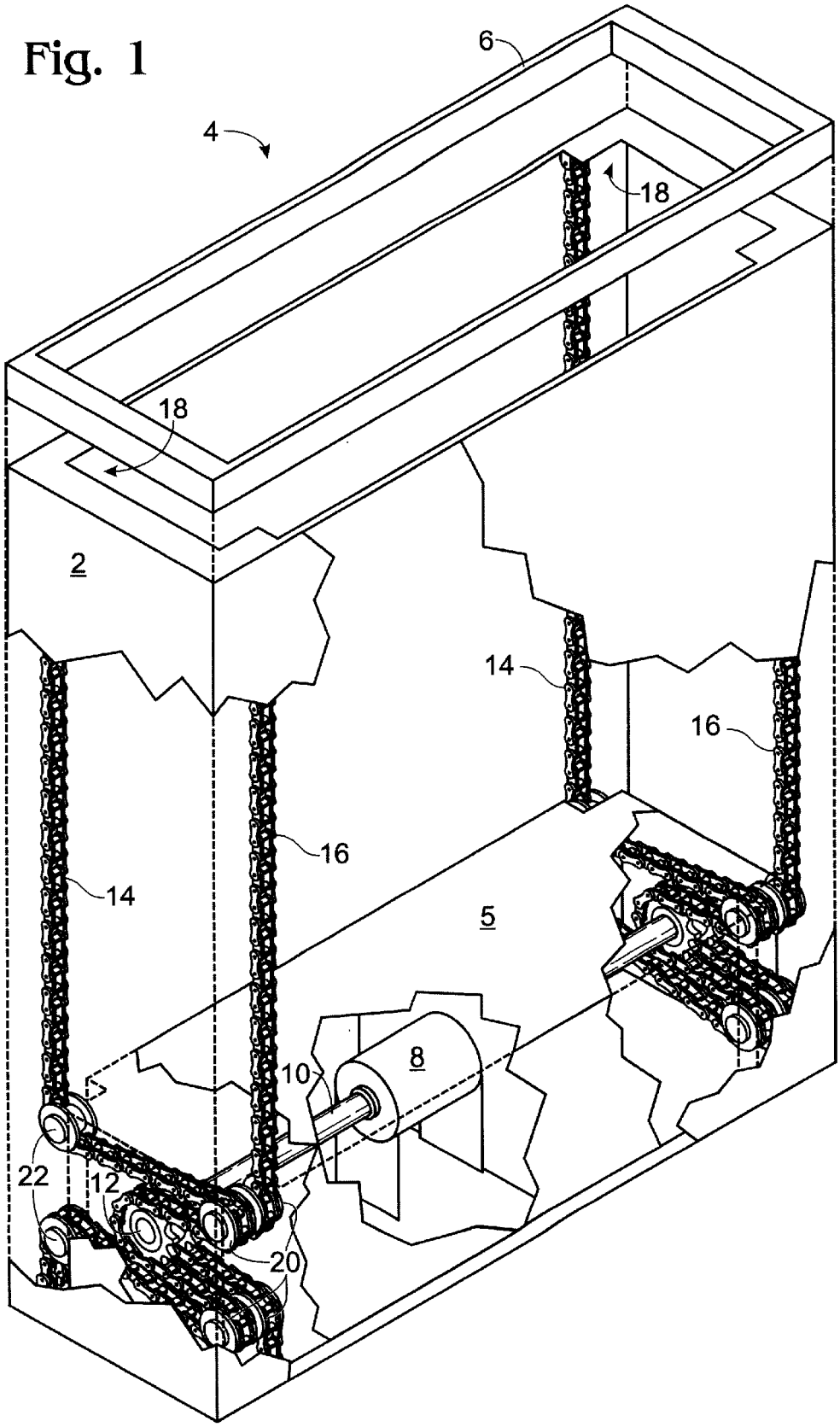
FIGS. 1–5 show a preferred embodiment of the linear actuator.

The linear actuator shown in FIG. 1 comprises a stationary frame 2 having an open end 4 with a moveable platform 5 within the frame 2 for supporting an object generally for vertical or horizontal movement of an object, this movement as vertical or horizontal movement defined relative to the position of the linear actuator in its environment. While most applications will utilize vertical or horizontal movement, an application may include other positions. A safety edge 6, preferably integrally molded of vinyl, can be fitted over the open end 4 of the frame 2, and serves as a finger guard as well as functioning to improve aesthetic appearances. Preferably the frame 2 is powder coated sheet steel, but can be made of any fairly rigid material, and can be clad with wood for a furniture appearance. The frame 2 is sized to fit the particular object or component and the particular use of that component—shown is a frame 2 with about a 12 inch by 48 inch footprint.

Means to drive the platform are mounted onto the platform 5 and shown is a reversible motor 8 mounted integrally to a drive axle 10 attached at each end of the platform 5 that extends from one end of the platform to the other. While an integral motor 8 and drive axle 10 is shown, a separate motor and drive axle combination can be also used.

A double drive sprocket 12 is mounted on each end of the drive axle 10, and each double drive sprocket 12 routes two chains, known as Chain A 14 and Chain B 16, for a total of four chains. Although chains are used in a preferred embodiment, timing belts or other flexible, fixed pitch devices can be used. Each chain 14 and 16 at each end of the platform 5 is attached inside the frame 2 at each inside corner 18, and provides a positive means for attaching the platform 5 to the frame 2. A pair of double idler pulleys 20 are mounted on each end of the platform, approximately adjacent the corners on one side of the end of the platform 5 and aligned with one of the vertical chains on each end, in these drawings aligned with Chains B 16. A pair of single idler pulleys 22 are mounted on each end of the platform 5 in the corners opposite the pair of double idler pulleys 20 and aligned with another of the vertical chains on each end, in these drawings aligned with Chains A 14. The pair of double idler pulleys 20 and the pair of single idler pulleys 22 are also positioned to contact with the frame 2, thereby acting as guide bearings for the platform 5 to travel up and down within the frame 2. Using the idler pulleys generally as guide bearings provides the advantages of smooth platform 2 travel, and limits any tilt the platform 2 may experience if the chains 14 and 16 stretch and have slightly different pitch lengths.

While the linear actuator is shown with the platform having two ends and four total chains, another embodiment for smaller items comprises a shortened platform and the exclusion of one set of chains A and B and their respective drive sprocket and idler pulleys, and therefore only two chains on one end of the platform.

Figure 3:
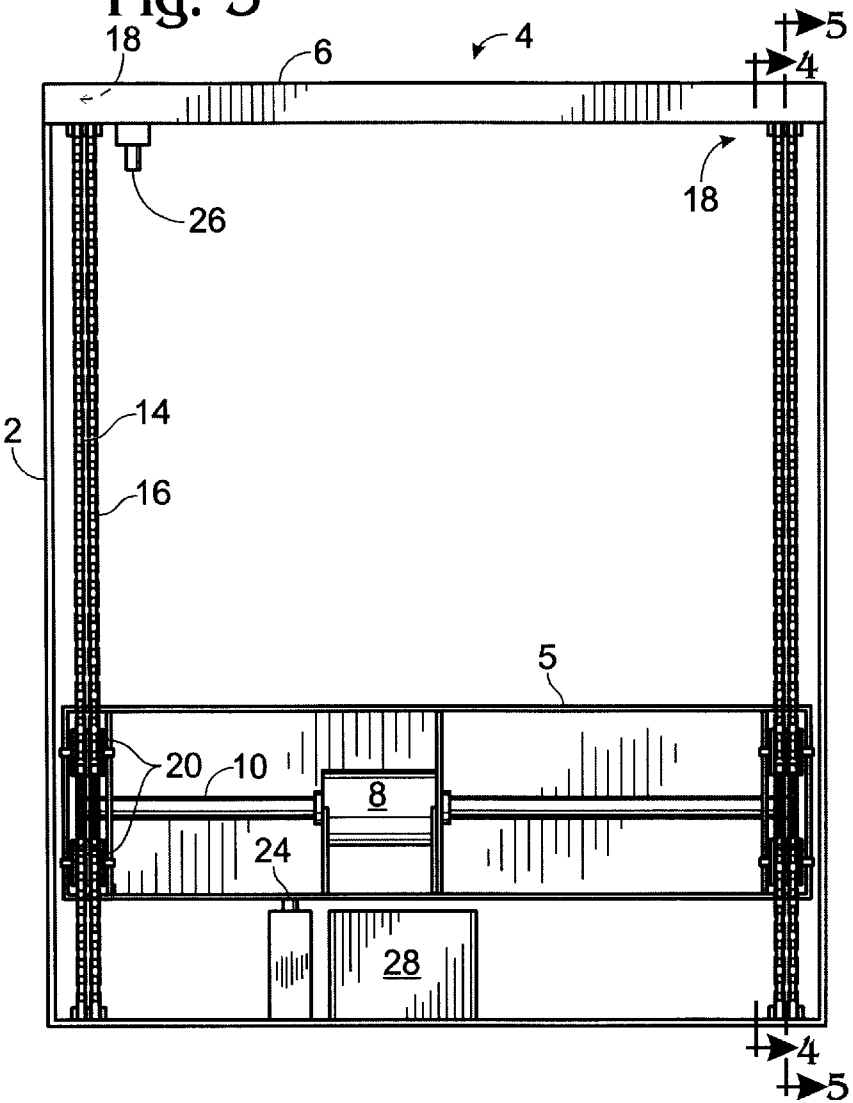
Figure 2:
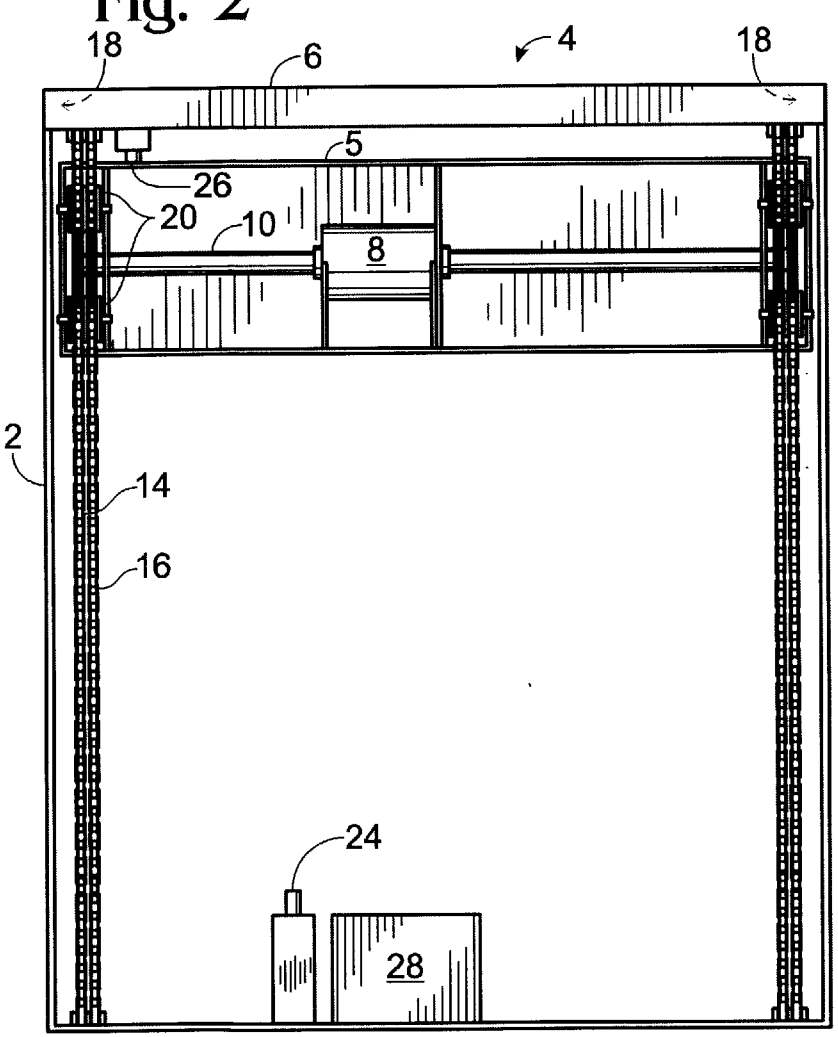

FIGS. 2 and 3 are front cut away views of the show the linear actuator shown in FIG. 1 further comprising a lower end travel limit switch 24 and a safety edge switch in conjunction with lower circuitry to control platform 5 lowering, and an upper end travel limit switch 26 in conjunction with raise control circuitry to control platform 5 raising. The lower limit switch is attached to the frame and positioned so as to limit movement of the platform downward in the closed position. The safety edge switch circumscribes the frame top edge, and is connected in the closed position in series with the lower limit switch so that any object contacting the safety edge and opening its switch will stop lowering movement. The upper limit switch 26 is attached to the frame and positioned so as to limit movement upward. A battery 28 as a power source allows mobile use of the linear actuator.

Figure 4:
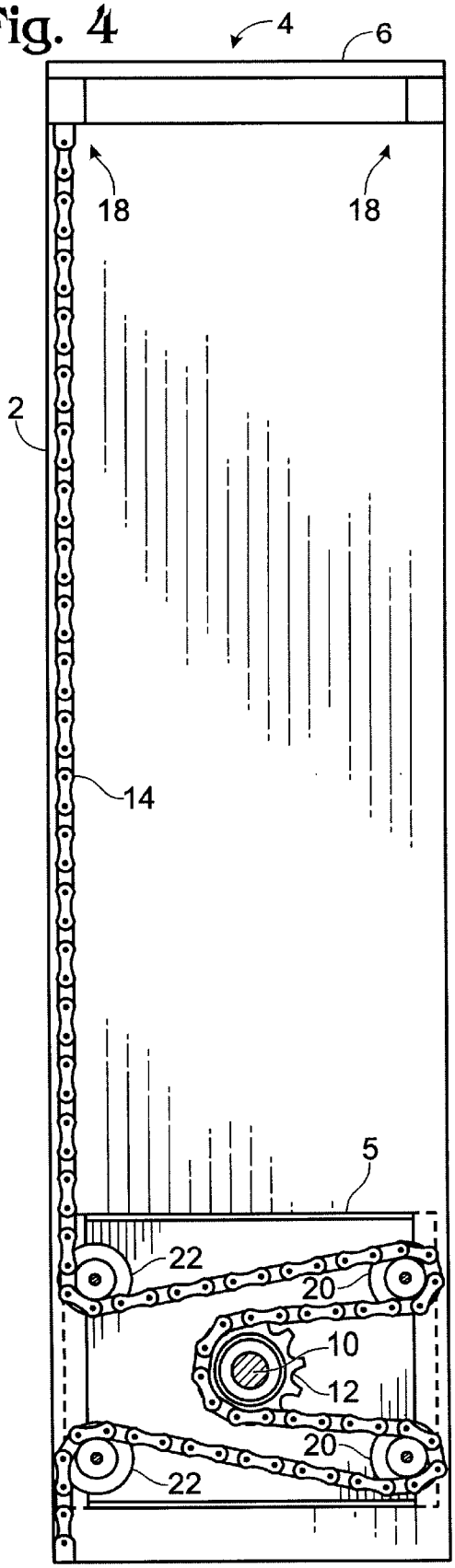
Figure 5:
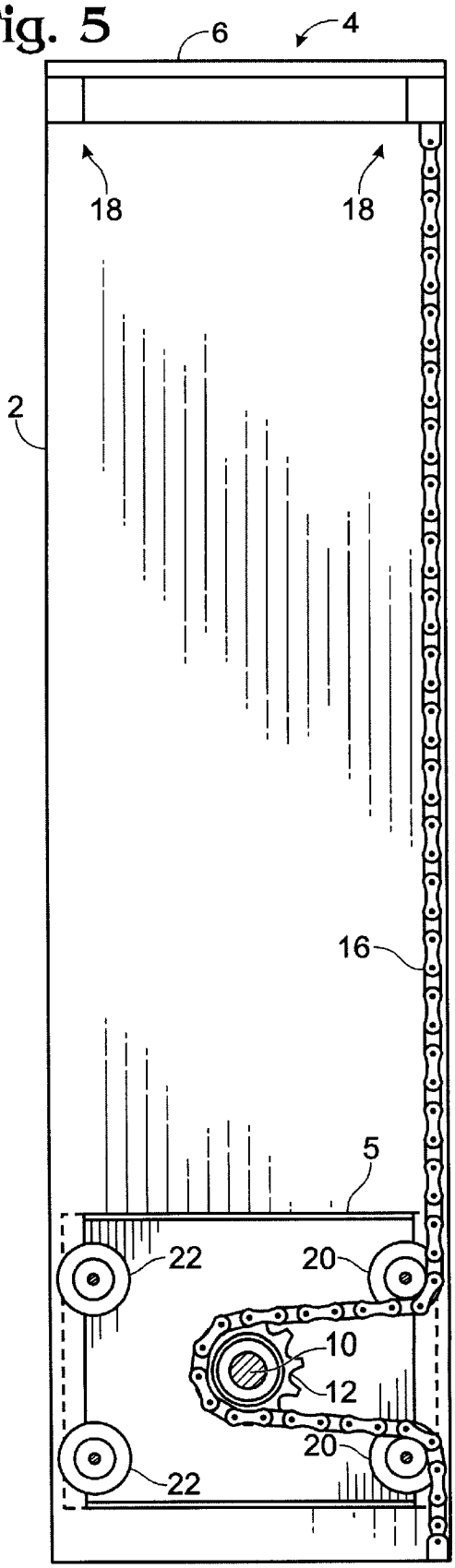

FIGS. 4 and 5 are cross sections along the lines shown in FIG. 3 and show the routing of each of the sets of two chains A and B 14 and 16 on one end of the platform. In FIG. 4, chain A 14 extends generally vertically from its attachment point at the top of the frame 2, engaging first of pair single idler pulley 22 then traveling generally horizontally to engage the opposite double idler pulley 20, there reversing direction to engage the double drive sprocket 12, reversing direction again to engage the second of pair double idler pulley 20, there reversing direction a third time and traveling generally horizontally to engage the second single idler pulley 22, from where it extends generally vertically to its attachment point at the bottom of the frame 2.

In FIG. 5, chain B 16 extends generally vertically from its attachment point at the top of the frame 2, engaging first of pair double idler pulley 20 then traversing to engage the double drive sprocket 12, reversing direction to engage the second of pair second double idler pulley, from where it extends generally vertically to its attachment point at the bottom of the frame 2. It is not critical as to which chain 14 or 16 has the outside or inside orientation or if the chains 14 or 16 are on identical orientations end to end.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is linear actuator for a platform, comprising:

1. A stationary frame having an open end;

a moveable platform within said frame for supporting an object for vertical or horizontal movement within and up to said open end of said frame, said platform having two ends;

a reversible motor driving an axle, said axle transversely mounted to said platform;

means for controlling and powering said motor;

and a drive system, comprising, a double drive sprocket mounted on an end of said axle;

a pair of flexible fixed pitch independent devices, each device fixed at its ends to said frame, and aligned with said platform's axis of travel, mounted substantially parallel whereby each device engages said double drive sprocket on its respective sprocket;

a pair of double idler pulleys mounted on said platform end and aligned with a device in said platform's axis of travel, whereby each device engages said double idler pulleys on its respective idler pulley;

a pair of single idler pulleys mounted on said platform end opposite said double idler pulleys, aligned with other device in said platform's axis of travel;

wherein said drive sprocket is located between said single idler pulley pair and said double idler pulley pair;

whereby said double idler pulleys route said device to engage said drive sprocket;

whereby said single idler pulleys route said other device to engage said double idler pulleys, and said double idler pulleys reverse device direction to engage said drive sprocket.

2. The linear actuator of claim 1 wherein said opposite end of said platform further comprises a drive system as in claim 1.

3. A linear actuator as in claim 1 further comprising upper and lower limit switches and control circuitry.

4. A linear actuator as in claim 1 wherein said flexible fixed pitch devices comprise chains.

5. A linear actuator as in claim 1 wherein said flexible fixed pitch devices comprise belts.

6. A linear actuator as in claim 1 further comprising a safety edge attached to a perimeter of said open end of said frame.

* * * * *